United States Patent [19]

Grassman

[11] 4,257,167

[45] Mar. 24, 1981

[54] ARRANGEMENT FOR SUPPORTING A WEB, ESPECIALLY A PAPER WEB

[75] Inventor: Hans-Christian Grassman, Igelsdorf, Fed. Rep. of Germany

[73] Assignee: Siemens Aktiengesellschaft, Berlin and Munich, Fed. Rep. of Germany

[21] Appl. No.: 77,110

[22] Filed: Sep. 19, 1979

[30] Foreign Application Priority Data

Sep. 22, 1978 [DE] Fed. Rep. of Germany ..... 2841371

[51] Int. Cl.[3] ..... F26B 13/20; F26B 23/08

[52] U.S. Cl. ..... 34/1; 34/156; 34/68; 219/10.69; 219/10.81

[58] Field of Search ..... 34/1, 156, 68; 219/10.81, 10.71, 10.69, 10.73

[56] References Cited

U.S. PATENT DOCUMENTS

| | | | |
|---|---|---|---|
| 3,532,848 | 10/1970 | Loring, Jr. et al. | 219/10.81 |
| 3,722,105 | 3/1973 | Marteny | 34/1 |
| 3,740,257 | 6/1973 | Roscher | 34/1 |
| 3,866,255 | 2/1975 | Serota | 34/1 |
| 3,952,421 | 4/1976 | Wilson et al. | 219/10.81 |
| 3,953,701 | 4/1976 | Manwaring | 219/10.81 |
| 4,036,676 | 7/1977 | Pennington | 219/10.81 |
| 4,055,295 | 10/1977 | Cohn | 34/1 |

*Primary Examiner*—Larry I. Schwartz
*Attorney, Agent, or Firm*—Kenyon & Kenyon

[57] ABSTRACT

Support of a paper web in a high-frequency drier is disclosed. The web is supported by flowing gases without contacting and at a defined distance from the stray field electrodes. The blowing or gas directing devices for the hot gases are provided in the form of nozzle chests which are disposed in or at the stray field electrodes.

5 Claims, 5 Drawing Figures

ARRANGEMENT FOR SUPPORTING A WEB, ESPECIALLY A PAPER WEB

BACKGROUND OF THE INVENTION

The present invention relates to an arrangement for supporting a web, especially a paper web, in a high-frequency drier.

For the residual drying of webs, especially paper webs, in the moisture range between 30 and 50% atro (absolute dry), high-frequency driers are used increasingly in conjunction with conventional drying sections of paper making machines. High efficiency and at the same time very high uniformity of the drying process can be achieved with such capacitive high-frequency driers (see, for instance, German Patenschrift No. 20 27 674). A problem, however, exists in the support of the web at the stray field electrodes by guide and deflection cylinders, since on the one hand, undesirable tensile stresses are produced thereby and, on the other hand, voltages which lead to harmful bearing currents are induced in the shafts. These bearing currents can be eliminated only with some difficulty.

SUMMARY OF THE INVENTION

It is an object of the present invention to provide improved support of a web in a capacitive high-frequency field. It is another object of the present invention to provide such an improved support in a high-frequency dryer using a reduced number of guide and/or deflection cylinders.

According to the invention, the web is conducted without contact at a defined distance from the stray field electrodes by flowing gases. In this manner, kraft paper, for example, can be dried largely without tensile stress and the number of cylinders can be reduced.

In the disclosed embodiments of the invention, blowing devices are provided in the form of nozzle chests. Advantageously, the nozzle chests are provided as stray field electrodes. Additional rod-shaped stray field electrodes may be provided and arranged, if desired, in an alternating fashion on different sides of the web. The gases emitted by the blowing devices to support the web are preferably hot gases. Steam clouds which may occur in the high-frequency drying process can thereby be removed and the formation of condensed water on the electrodes can be prevented.

In accordance with the invention, apparatus is provided for supporting a web, especially a paper web, in a high-frequency drier, said apparatus comprising stray field electrodes including means for directing gases at the web to support the web without contacting the stray field electrodes at a predetermined distance from the stray field electrodes.

In the disclosed embodiments, the directing means comprise nozzle chests formed as part of the stray field electrodes. The stray field electrodes including the nozzle chests for directing gas, and other stray field electrodes are alternatively disposed in one embodiment with respect to the direction of movement of the web. In another embodiment, the stray field electrodes having nozzle chests and the other electrodes are disposed on opposed sides of the paper web. The nozzle chests are advantageously operative to direct hot gases, and heated air in particular.

It should be noted that so-called suspended-web driers have been known as a substitute for and in competition with the conventional cylinder driers in the drying sections of paper-making machines (see, for example, U.S. Pat. Nos. 3,982,328 and 3,979,038). In these driers, the web is supported and dried without contact by flowing hot gases. However, the range of application in driers of this type is limited to a range above 30% atro, as below this limit, the efficiency of the hot-air drying process falls because of increasing heat transfer resistance.

These and other aspects of the invention will be more apparent from the following description of the preferred embodiments when considered with the accompanying figures.

BRIEF DESCRIPTION OF THE DRAWINGS

The present invention is illustrated by way of example and not limitation in the figures of the accompanying drawings in which like numerals indicate similar parts and in which.

DESCRIPTION OF THE PREFERRED EMBODIMENTS

Figure 1:
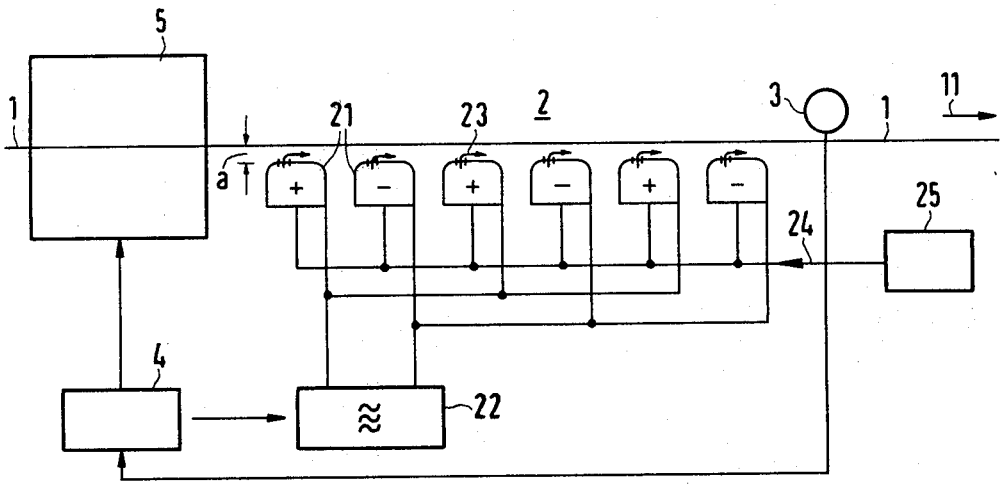
FIG. 1 is a schematic diagram of a high frequency drying apparatus according to the invention in a paper-making machine.

As shown in FIG. 1, the paper web 1 to be dried passes in the direction of the arrow 11 through a cylinder drier 5, in which it is pre-dried to a moisture of about 30% atro. Subsequently, the paper web 1 passes through a capacitive high-frequency drier 2 and is dried there to the desired residual moisture. The resulting moisture is determined by a measuring device 3 and fed into a computer 4 which controls the cylinder drier 5 and the high-frequency generator 22 of the high-frequency drier 2. The high-frequency generator 22 may operate, for example, at 30 MHz. The capacitive high-frequency drier comprises stray field electrodes 21 alternatingly connected to different poles of the high-frequency generator 22, as viewed in the direction of movement of the web. For simplicity, only one plane with a few electrodes is shown; it is understood, however, that the web may run through a multiplicity of electrode planes.

The stray field electrodes 21 are provided as nozzle chests or blow boxes such as are used in the so-called suspended-web driers to support the paper web 1 at a defined distance "a" from the electrodes. The hot air 23 which is emitted from the nozzle chests of the stray field electrodes 21 is supplied from a source of hot air 25 via a line 24. In addition to supporting the web 1, the hot air removes steam clouds produced by the high-frequency drying process.

Figure 2A:
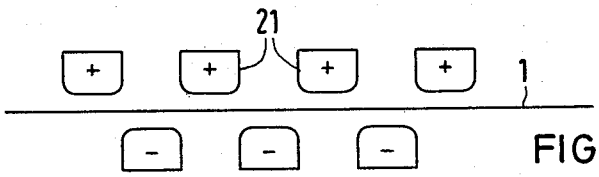
FIGS. 2*a* to 2*d* are schematic diagrams of embodiments of electrode arrangements at the paper web according to the invention.

In the arrangement shown in FIG. 2*a*, the nozzle chest stray field electrodes 21 are arranged with different polarities on opposed sides of the paper web 1.

Figure 2B:
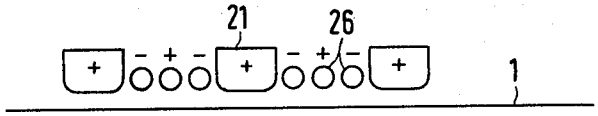

In the arrangement shown in FIG. 2*b*, conventional rod-shaped electrodes 26 are provided in addition to the nozzle chest stray field electrodes and are interposed on the same side of the paper web between the nozzle chest stray field electrodes 21.

Figure 2C:
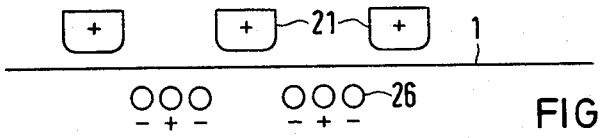
Figure 2D:
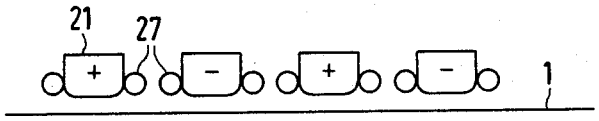

In the arrangement shown in FIG. 2*c*, conventional electrodes 26 and nozzle chest stray field electrodes 21 are disposed on opposed sides of the paper web 1.

To minimize the capacities between the nozzle chest stray field electrodes 21, rod-shaped electrodes 27 are welded to the nozzle chest stray field electrodes, as shown in FIG. *2d;* the electric field extending essentially between the electrodes.

The advantages of the present invention, as well as certain changes and modifications of the disclosed embodiments thereof, will be readily apparent to those skilled in the art. It is the applicant's intention to cover by his claims all those changes and modifications which could be made to the embodiment of the invention herein chosen for the purposes of the disclosure without departing from the spirit and scope of the invention.

What is claimed is:

1. High frequency drying apparatus for drying and supporting a web, especially a paper web, comprising stray field electrodes adapted to be coupled to a high frequency source and which include electrically conductive nozzle chests for directing gases at the web to support the web at a predetermined distance from the stray field electrodes without contacting the stray field electrodes, said nozzle chests constituting part of the stray field electrodes and thereby also adapted to be coupled to the high frequency source.

2. The apparatus according to claim 1, in which a rod-shaped electrode is secured to each of opposed ends of the stray field electrodes, said stray field electrode ends being referenced with respect to the path of travel of the web.

3. The apparatus according to claim 1, in which stray field electrodes including nozzle chests for directing gas are alternatingly disposed with additional stray field electrodes with respect to the direction of movement of the web.

4. Apparatus according to claim 3, in which stray field electrodes having nozzle chests and the additional electrodes are disposed on opposed sides of the paper web.

5. Apparatus according to claims, 3 or 4, in which the nozzle chests are operative to direct hot gases.

* * * * *